United States Patent [19]

Ikesue et al.

[11] Patent Number: 4,744,493

[45] **Date of Patent: * May 17, 1988**

[54] TONER REPLENISHING DEVICE

[75] Inventors: Masumi Ikesue, Tokyo; Takashi Ikeda, Sagamihara, both of Japan

[73] Assignee: Ricoh Company, Ltd., Tokyo, Japan

[ * ] Notice: The portion of the term of this patent subsequent to Feb. 10, 2004 has been disclaimed.

[21] Appl. No.: 866,414

[22] Filed: May 23, 1986

Related U.S. Application Data

[63] Continuation of Ser. No. 598,022, Apr. 9, 1984, Pat. No. 4,611,730.

[30] Foreign Application Priority Data

Jan. 9, 1984 [JP] Japan ..... 59-1729

[51] Int. Cl.[4] ..... B67D 5/64; B67D 3/00; B65D 88/54; B67C 3/26

[52] U.S. Cl. ..... 222/167; 222/325; 222/414; 222/564; 222/565; 222/DIG. 1; 141/256; 141/363; 355/3 DD

[58] Field of Search ..... 222/167, 325, 414, 564, 222/565, DIG.1, 83.5; 141/265, 363, 384, 256; 355/3 DD

[56] References Cited

U.S. PATENT DOCUMENTS

| | | | |
|---|---|---|---|
| 2,534,782 | 12/1950 | Maddux | 222/564 X |
| 2,720,340 | 10/1955 | Gustafson | 222/167 |
| 3,526,341 | 9/1970 | Johnston | 222/167 |
| 3,589,568 | 6/1971 | Hoelscher | 222/167 |
| 3,901,411 | 8/1975 | Bauman | 222/167 |
| 3,979,026 | 9/1976 | Lee | 222/167 X |
| 4,062,476 | 12/1977 | Brand et al. | 222/167 X |
| 4,164,306 | 8/1979 | Perrin | 222/325 X |
| 4,212,264 | 7/1980 | Knechtel et al. . | |
| 4,561,567 | 12/1985 | Wittstein | 222/83.5 |
| 4,611,730 | 9/1986 | Ikesue et al. | 222/167 |
| 4,641,945 | 2/1987 | Ikesue et al. | 222/325 |

*Primary Examiner*—Joseph J. Rolla
*Assistant Examiner*—Gregory L. Huson
*Attorney, Agent, or Firm*—Oblon, Fisher, Spivak, McClelland & Maier

[57] ABSTRACT

A toner replenishing device for replenishing toner to a toner storage area, from where the toner is supplied to a developing section, includes a holder for releasably holding a cartridge containing therein a quantity of toner, which may be located at a cartridge mounting and dismounting position and at a replenishing position, in which the cartridge is held substantially horizontally and driven to rotate thereby discharging the toner to a toner transporting path leading to the toner storage area. The cartridge is provided with a first mating member and the holder is provided with a second mating member corresponding in position to the first mating member. Thus, only the cartridge having the first mating member may be properly held by the holder for carrying out a toner replenishing operation.

13 Claims, 11 Drawing Sheets

TONER REPLENISHING DEVICE

This is a continuation, of application Ser. No. 598,022, filed Apr. 9, 1984, now U.S. Pat. No. 4,611,730.

BACKGROUND OF THE INVENTION

1. Field of the Invention

This invention generally relates to imaging machines and particularly to a toner replenishing device for use in a dry-type electrophotographic copier.

2. Description of the Prior Art

A device for replenishing toner to a toner storage area defined in a dry-type copier is well known in the art. Such a replenishing device is necessary because as the copier is used, the toner in the storage area becomes scarce. FIGS. 1*a* through 1*d* show several prior art toner replenishing devices for use in replenishing a supply of toner to the storage area of a dry-type copier. In the toner replenishing devices shown in FIGS. 1*a* and 1*b*, a toner cartridge containinig therein a quantity of toner to be replenished is first attached and then the cartridge is turned upside down to dump the toner to the toner storage area in the copier from the cartridge by its own weight. In the device shown in FIG. 1*c*, use is made of a cylindrical cartridge provided with a slot extending axially in its peripheral wall, which is rotated after peeling off a seal member to dump the toner to the toner storage area. Moreover, in the case of FIG. 1*d*, a toner cartridge comprises a bottle and an L-shaped pipe fixedly held at the mouth of the bottle, and this bottle cartridge is rotated as held inclined to replenish the toner storage area with fresh toner.

However, in the above-described toner replenishing devices in which the toner cartridge is turned upside down to dump fresh toner to the toner storage area, it is required to provide a relatively large cartridge receiving space H above a developing unit in the copier, so that it cannot be applied to compact copiers having the developing unit disposed at its top. On the other hand, in the case of the cylindrical toner cartridge, the slot cannot be made sufficiently larger because it must also be sealed, and, thus, it is likely that the slot becomes partly plugged. Further, the prior art structure of the type shown in FIG. 1*d* also requires a relatively large space because the cartridge must be held inclined, and, in addition, difficulty is also present in dumping all of the toner contained in the cartridge because of its peculiar structure.

SUMMARY OF THE INVENTION

It is therefore a primary object of the present invention to obviate the disadvantages of the prior art as described above and to provide an improved toner replenishing device for use in a dry development type copier.

Another object of the present invention is to provide a toner replenishing device which may be easily provided in a copier having its developing device disposed at top within a housing.

A further object of the present invention is to provide a toner replenishing device which allows to mount and detach its associated toner cartridge with ease.

A still further object of the present invention is to provide a toner replenishing device capable of transferring fresh toner to a toner storage area from a cartridge securely without loss and scattering.

A still further object of the present invention is to provide a toner replenishing device which is so structured that only a particular toner cartridge may be mounted in position for toner replenishing operation.

A still further object of the present invention is to provide a toner replenishing device which allows to insure that toner of the same kind or property may be replenished at all times.

A still further object of the present invention is to provide a toner replenishing device which allows to transfer toner from a cartridge to a toner storage area at a regulated rate thereby insuring a smooth toner transfer operation.

A still further object of the present invention is to provide a toner cartridge which is so structured to discharge toner through its mouth at a regulated rate.

Other objects, advantages and novel features of the present invention will become apparent from the following detailed description of the invention when considered in conjunction with the accompanying drawings.

BRIEF DESCRIPTION OF THE DRAWINGS

FIGS. 2*a* and 2*b* are perspective views of the present toner replenishing device wherein FIG. 2*a* shows a toner cartridge and FIG. 2*b* shows a toner replenishing device in which the cartridge of FIG. 2*a* is to be mounted for replenishing operation;

FIGS. 7*a* and 7*b* are perspective views of the toner replenishing device having a mating mechanism so as to allow only a particular toner cartridge to be mounted in position for replenishing operation, wherein FIG. 7*a* shows a toner cartridge 6 provided with a flange 65 and FIG. 7*b* shows a toner replenishing device 4 provided with a mating groove 58 in which the flange 65 is insertable when the cartridge 6 is mounted in position for toner replenishing operation;

DESCRIPTION OF THE PREFERRED EMBODIMENTS

Figure 1A:
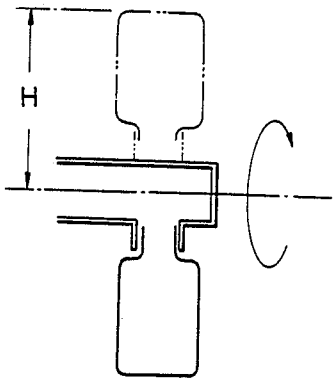
Fig. 1a PRIOR ART
FIGS. 1*a* through 1*d* are schematic illustrations showing several prior art toner replenishing schemes.
Figure 1B:
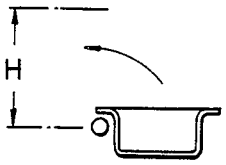
Fig. 1b PRIOR ART
Figure 1C:
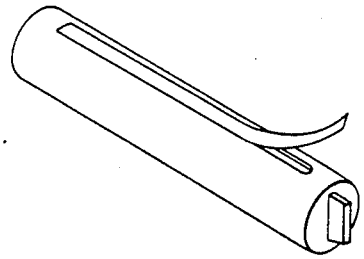
Fig. 1c PRIOR ART
Figure 1D:
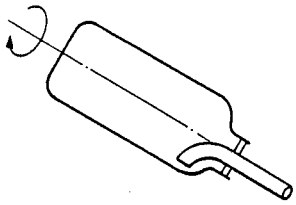
Fig. 1d PRIOR ART
Figure 2A:
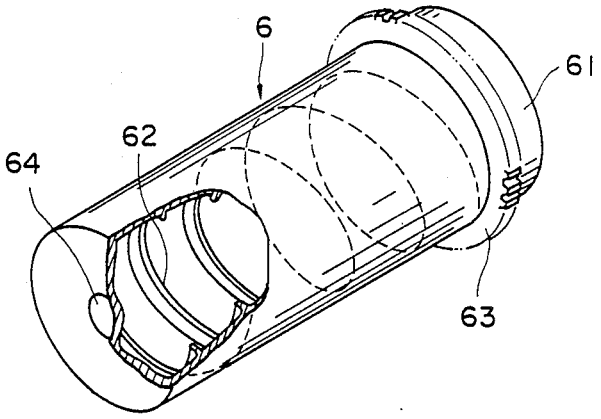
Figure 2B:
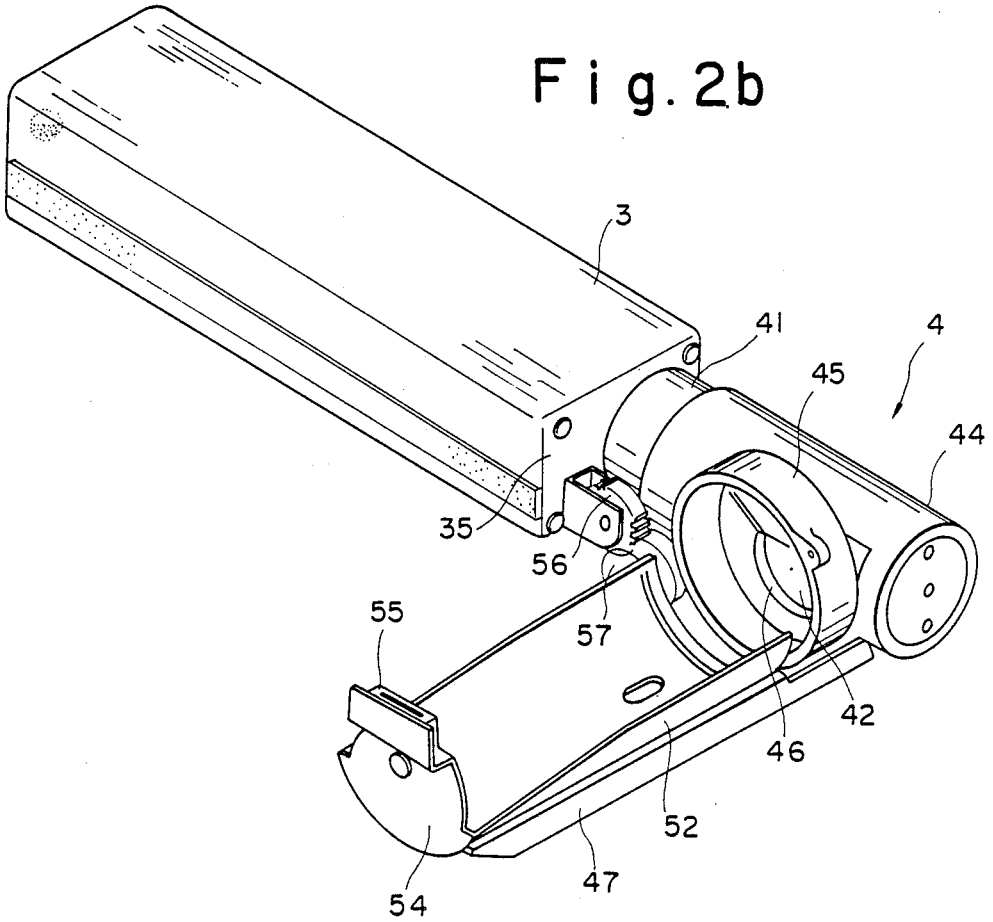
Figure 3:
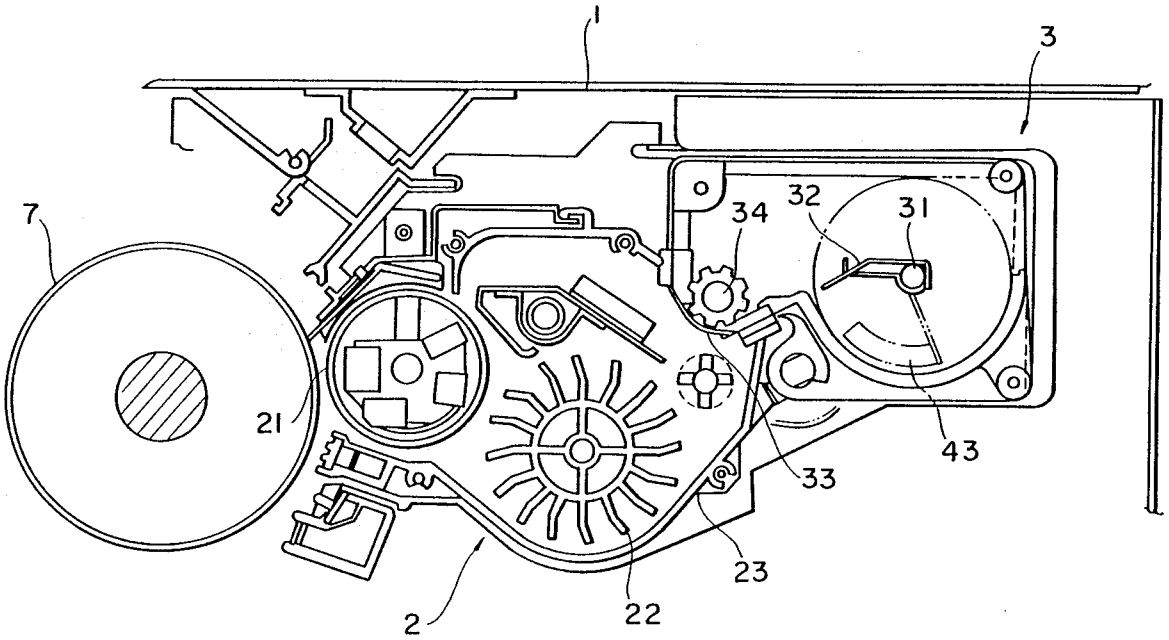
FIG. 3 is a schematic illustration showing the structure of a dry-development type electrophotographic copier in which the toner replenishing device of FIGS. 2*a* and 2*b* is provided.

Referring now to FIGS. 2*a* and 2*b*, there is shown a toner replenishing device which may be provided in a copier for transporting the toner contained in a toner cartridge 6 to a developing device or a toner storage area also provided in the copier. That is, as shown in FIG. 3, an electrophotographic copier includes a developing device 2 inside of its housing 1 and adjacent to a photosensitive drum 7 on which an electrostatic latent image to be developed by the developing device 2 is formed by any of the well known latent image forming processes. The developing device 2 includes a developing roller 21, which is rotatably supported and disposed adjacent to the photosensitive drum 7, and an impeller 22 which is also driven to rotate thereby transporting toner to the developing roller 21. The developing device 2 also includes a casing 23 which defines the bottom boundary of the developing device 2 and, in effect, a toner reservoir for temporarily storing fresh toner to be supplied to the developing roller 21.

Adjacent to the developing device 2 is provided a toner storage box 3 which is in the shape of an elongated box and through which extends shaft 31 provided with an agitator 32 for stirring the toner supplied therein. The toner storage box 3 also includes a toner supply roller 34 which is provided at a supply port 33 in communication with the interior space of the developing device 2 and which is driven to rotate in accordance with a signal supplied from a toner density detector ( not shown ). There is also provided a toner replenishing device 4 at one end of the storage box 3, and the toner replenishing device 4 is so structured to detachably hold a toner cartridge 6 in position for replenishing operation. The toner cartridge 6 thus held is driven to rotate in association with the toner supply roller 34 to thereby cause the toner stored into the box 3 to be supplied to the developing device 2 through the supply port 33.

As shown in FIG. 2*b*, a cylinder member 41 projects from an end plate 35 at the operating side of the toner storage box 3, and the shaft 31, which extends through the toner storage box 3, further extends through the cylinder member 41 centrally. The shaft 31 is provided with a spirally shaped toner transport plate 43 ( see FIGS. 4 and 5 ) for transporting the toner supplied into the cylinder member 41 through an opening 42 formed in the peripheral wall of the cylinder member 41 into th toner storage box 3. A supporting sleeve 44 is rotatably fitted onto the cylinder member 41, and integrally provided with the supporting sleeve 44 is a cap-shaped receptacle 45 in which the mouth of the cartridge 6 may be rotatably and sealingly received. The cap-shaped receptacle 45 is provided with an opening 46 which comes into alignment with the opening 42 of the cylinder member 41 when the supporting sleeve 44 is rotated with respect to the cylinder member 41 to locate the receptacle 45 horizontally.

Figure 6:
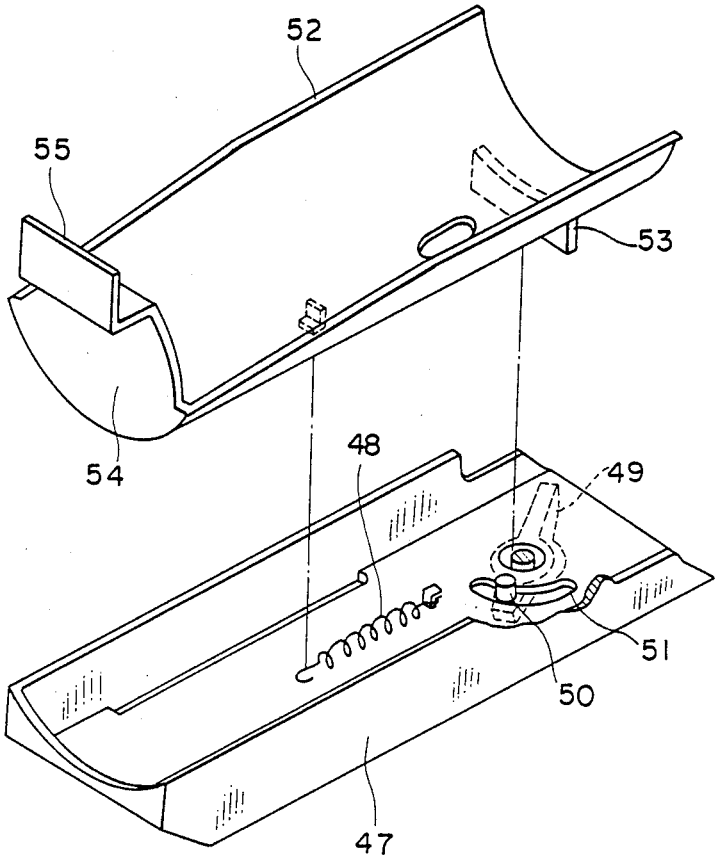
FIG. 6 is an exploded, perspective view showing part of the toner replenishing device of FIG. 4.
Figure 7A:
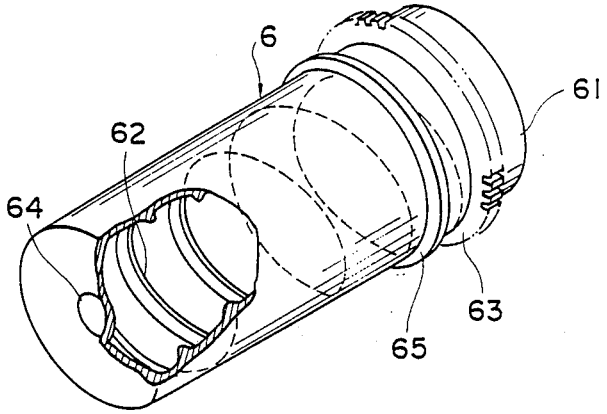
Figure 7B:
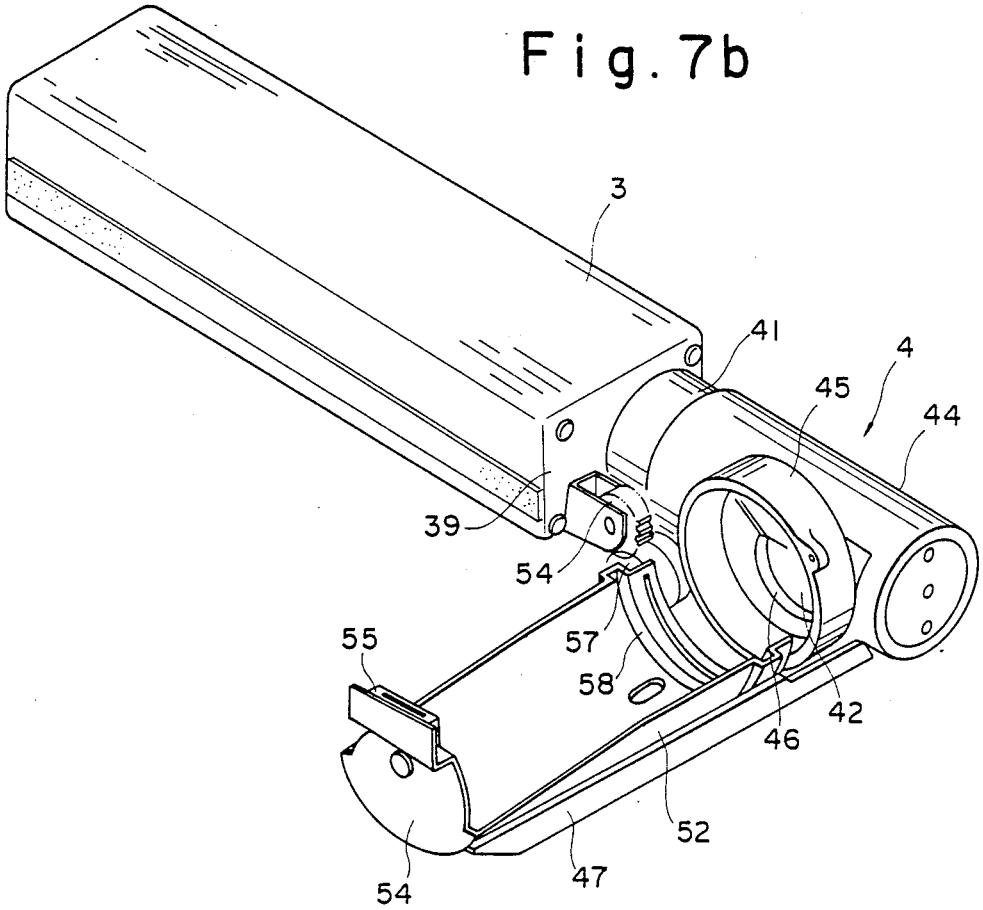

The toner replenishing device 4 further includes a cartridge supporting arm 47 which is fixedly attached to the receptacle 45 by means of screws 48. As best shown in FIG. 6, on the supporting arm 47 is provided a holder 52 for holding therein the cartridge 6, and a tension spring is provided as extending between the supporting arm 47 and the holder 52 such that the holder 52 is normally biased toward the cap-shaped receptacle 45. As also shown in FIG. 6, there is also provided a pivotal knob 49 at the bottom surface of the supporting arm 47. The knob 49 is provided with an integral pin 50 which projects through an arc-shaped slot 51 formed in the supporting arm 47 such that the pin 50 is in engagement with an engaging plate 53 integrally provided on the holder 52. Thus, the holder 52 may be moved along its longitudinal axis with respect to the supporting arm 47 by pivotting the knob 49.

The holder 52 slidably supported on the supporting arm 47 is provided with an upright bottom plate 54 which may abut against a bottom central portion 64 of the cartridge 6. A magnet 55 is fixedly attached to the bottom plate 54 and thus the magnet 55 may be brought into contact with a magnet 11 fixedly provided on the housing 1 to hold the toner cartridge 6 horizontally as will be more fully described with respect to FIG. 4.

As shown in FIG. 2*b*, a pinion 56 is rotatably supported at the end surface 35 of the toner storage box 3, and the pinion 56 is brought into mesh with a gear 63 integrally provided around the periphery of the cartridge 6 when the supporting arm 47 is turned to its horizontal position. The pinion 56 is driven to rotate by receiving a driving rotational force as transmitted from a worm gear 36 mounted at the tip end of the toner supply roller shaft 35 ( see FIG. 5 ) which extends beyond the end wall of the toner storage box 3 through an idler gear 57. With this rotational force, the toner cartridge 6 is driven to rotate in synchronism with the toner supply roller 34.

As shown in FIG. 2*a*, the toner cartridge 6 is preferably comprised of a resin material and includes a cylindrical main body. There is provided a spirally shaped guide rib 62 extending along the inner peripheral surface of the cylindrical main body of the cartridge 6. The guide rib 62 starts from the bottom of the cartridge 6 and terminates at its mouth 61 so that the toner contained in the cartridge 6 may advance toward the mouth 61 when the cartridge 6 is rotated as held horizontally. As described briefly before, the gear 63 is fixedly provided around the cylindrical main body as located closer to the mouth 61. The gear 63 also serves as a reinforcing element to provide mechanical strength to the cartridge. As set forth above, the gear 63 is brought into mesh with the pinion 56 when the cartridge 6 is set in the horizontal position, which is the operative position for carrying out a toner replenishing operation.

Figure 4:
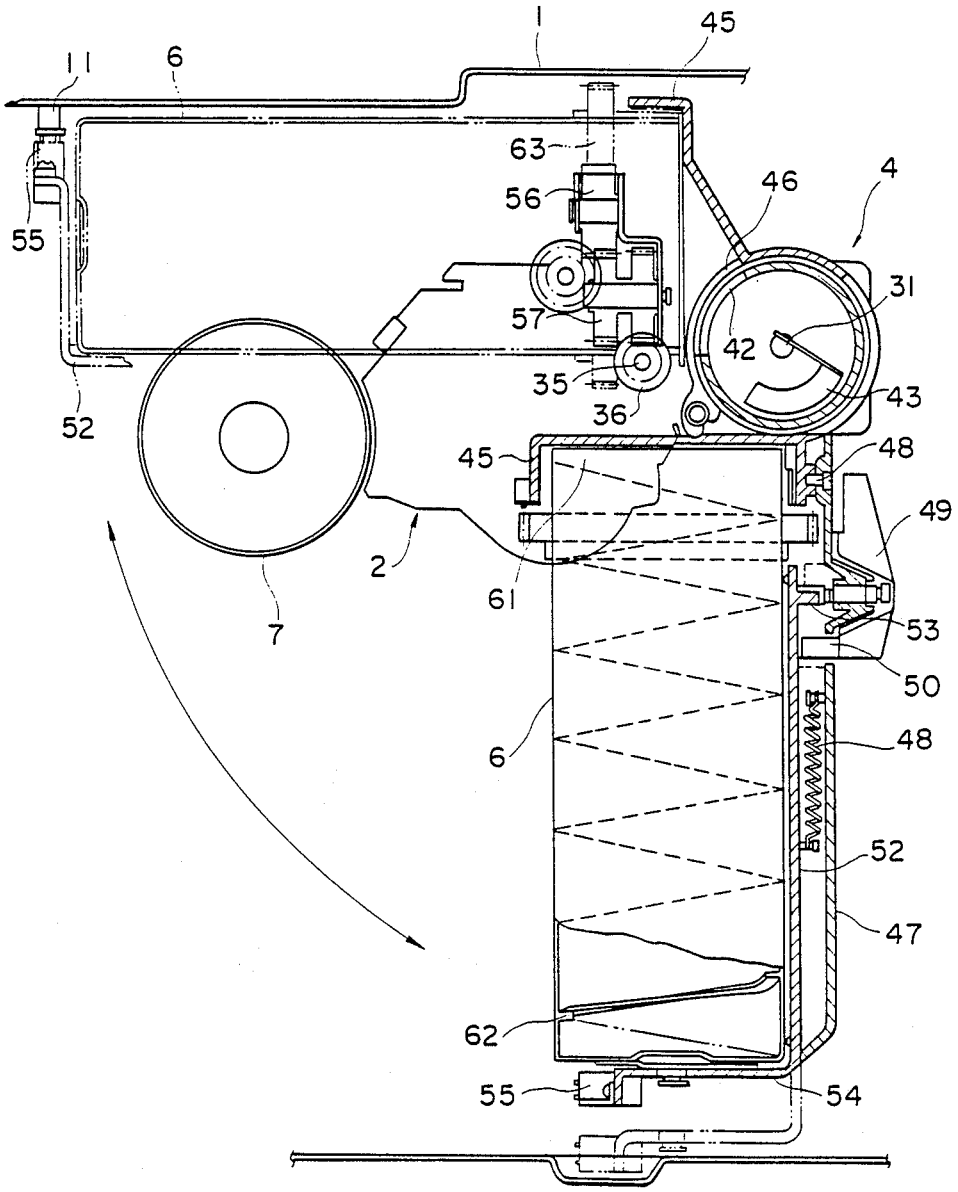
FIG. 4 is a schematic illustration showing the detailed structure of the toner replenishing device provided in the copier as shown in FIG. 3 and useful for explaining the toner replenishing operation.
Figure 5:
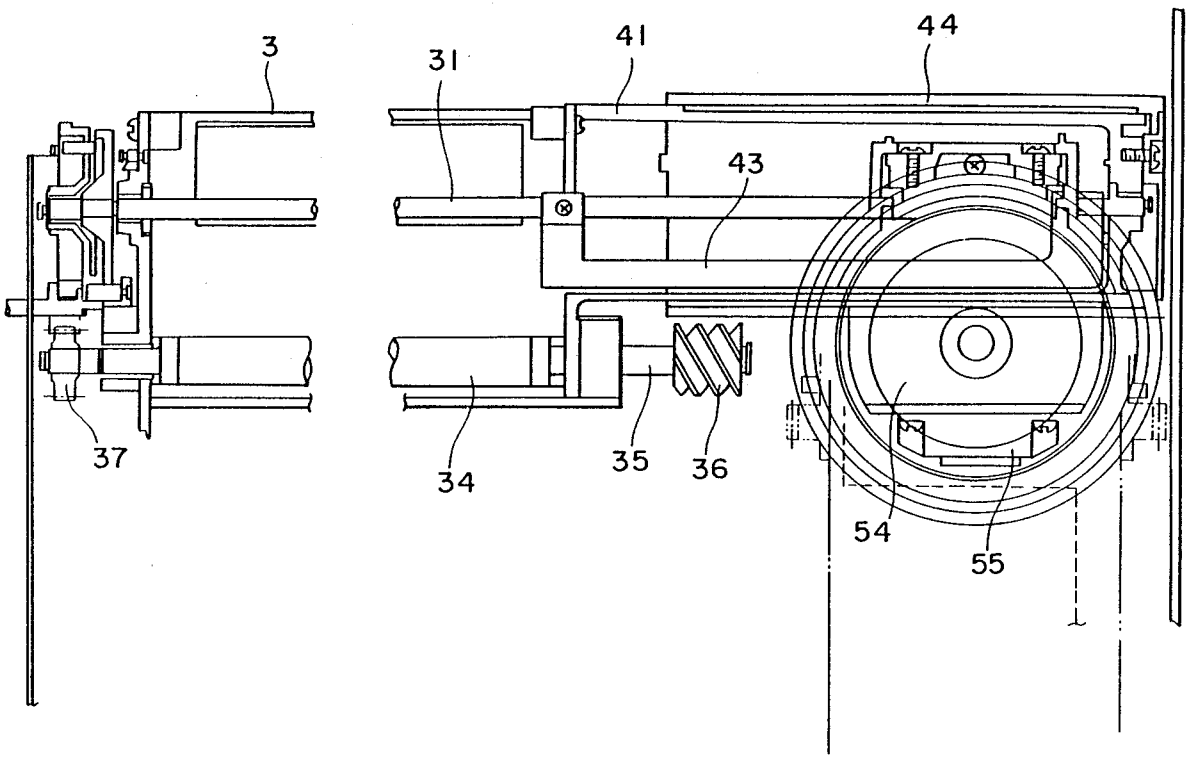
FIG. 5 is a plan view of the structure shown in FIG. 4.

In operation, the supporting arm 47 is rotated counterclockwise around the cylinder member 41 to be located at a cartridge in/out position indicated by the solid line in FIG. 4. Then, the knob 49 is pivotted to move the holder 52 downward through the engagement between the engaging plate 53 and the pin 50 of knob 49 to a lowered position indicated by the two-dotted line in FIG. 4. Thus, the toner cartridge 6 received in the holder 52 is pulled out of the cap-shaped receptacle 45. Under the condition, the toner cartridge 6 may be removed from the holder 52 and a new cartridge 6 may be inserted into the holder 52. Then, when the knob 49 is pivotted back to its original position, the holder 52 now holding therein a new cartridge 6 moves upward due to the recovery force of the spring 48 so that the mouth 61 of the new cartridge 6 is fitted into the cap-shaped receptacle 45.

Then the supporting arm 47 is rotated clockwise over 90 degrees in FIG. 4 to bring the magnet 55 of the supporting arm 47 in contact with the magnetically attractable element 11 fixedly provided on the housing 1, so that the supporting arm 47 and thus the cartridge 6 now comes to be held horizontally as indicated by the two-dotted line in FIG. 4. When so located, the gear 63 of the cartridge 6 is brought into mesh with the pinion 56, and, moreover, the opening 46 of the cap-shaped receptacle 45 comes into alignment with the opening 42 of the cylinder member 41, thereby allowing the toner contained in the cartridge 6 to be supplied into the cylinder member 41 and further into the storage box 3.

When the developing operation is repetitively carried out and thus the toner density within the developing device 2 decreases, an electromagnetic clutch (not shown) is activated in response to an activation signal supplied from a toner density detector (not shown) to start to rotate the toner supply roller 34 mounted on the shaft 35. In association therewith, the worm gear 36 also mounted on the shaft 35 starts to rotate thereby causing to rotate the cartridge 6 rotatably supported on the adaptably shaped holder 52 through the pinion 56. As described previously, since the spiral guide rib 62 is provided along the inner peripheral surface of the cartridge 6, the toner contained in the cartridge 6 is gradually moved toward the mouth 61 and thus enters into the cylinder member 41 through the aligned openings 46 and 42. Then the toner is further transported into the storage box 3 by means of the toner transport plate 43 mounted on the shaft 31 which is normally in rotation. This operation continues until the toner supply roller 34 comes to a halt with the density of the toner within the developing device 2 reaching a predetermined value.

Figure 8:
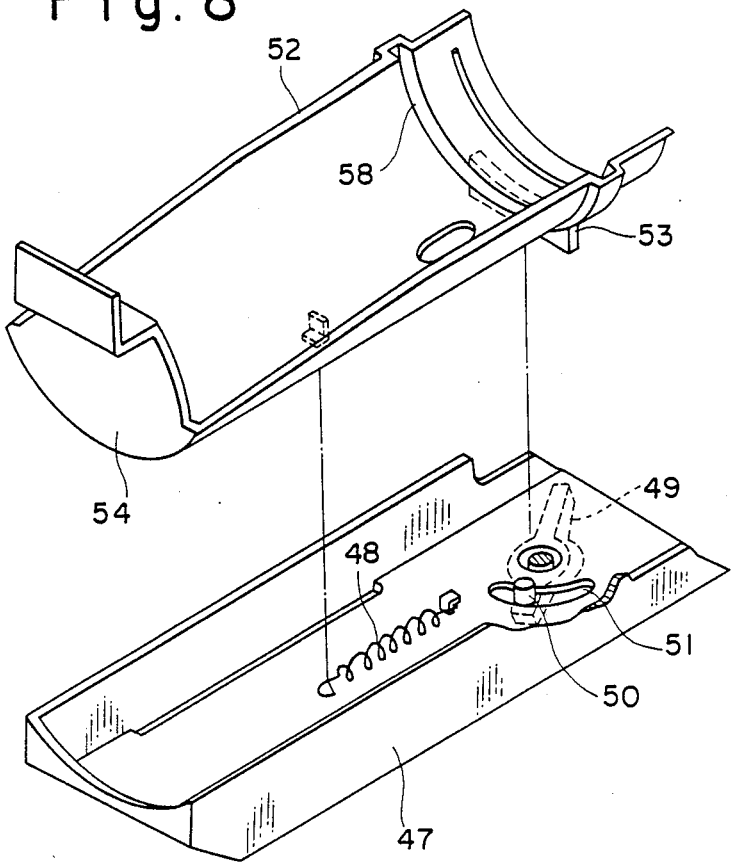
FIG. 8 is an exploded, perspective view showing part of the toner replenishing device illustrated in FIGS. 7*a* and 7*b;*

FIGS. *7a*, *7b* and 8 show the toner replenishing device embodying the present invention, which allows only a particular toner cartridge to be mounted in position for toner replenishing operation. As shown, the toner cartridge 6 in this embodiment includes a flange 65 provided around the outer peripheral surface of the cylindrical portion adjacent to the gear 63. The holder 52 is also provided with a mating groove 58 corresponding in position to the flange 65, so that the flange 65 comes to be inserted into the mating groove when the cartridge 6 is placed as properly received in the holder 52. In the above-described embodiment, the flange or projection 65 is provided on the cartridge 6 and the mating groove 58 is provided in the holder 52; however, this may be interchanged with the projection 65 provided on the holder 52 and the mating groove 58 provided in the cartridge 6. It should also be noted that more than one pair of mating projection and groove may be provided, if desired. Moreover, the projection 65 does not need to be in the form of a flange and it may take any other appropriate shape. Of course, the mating groove 58 may have a shape other than the one shown in FIG. 8 as long as it is shaped to be properly engageable with the projection 65. Such a structure is particularly advantageous because the kind or type of the toner to be supplied may be maintained unchanged. In this instance, the projection or flange 65 serves as an identifier which identifies the type or kind of the toner contained in the cartridge 6.

Figure 9:
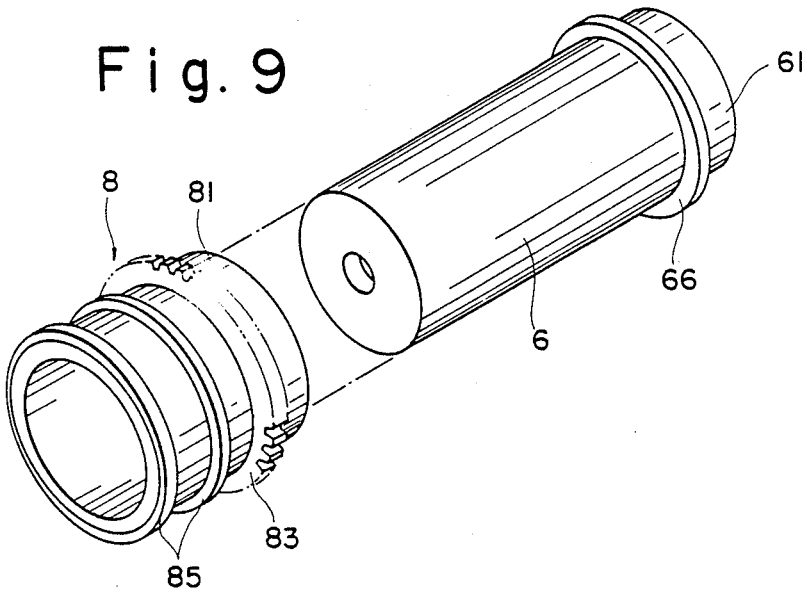
FIG. 9 is an exploded, perspective view showing the toner cartridge constructed in accordance with another embodiment of the present invention.

FIG. 9 illustrates another embodiment of the toner cartridge 6. In this case, a toner identifier 8 is separately formed and it is snugly fitted onto the cylindrical toner cartridge 6 until it comes into abutment against a stopper ring 66 integrally formed around the outer peripheral surface of the cartridge 6. As shown, the toner identifier 8 includes a cylinder base 81 on which is integrally formed a gear 83 and a pair of flange projections 85, 85. In this embodiment, the same toner cartridges 6 may be used as containers for containing therein different kinds of toner because the identifier 8 may identify several different kinds of toner by removing either one or both of the flange projections 85, 85.

Figure 10A:
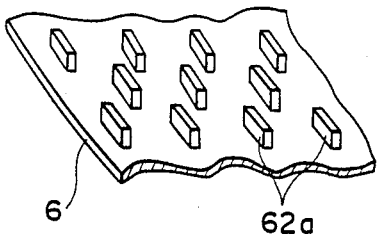
FIGS. 10*a* through 10*d* are schematic, partial illustrations showing several embodiments of the guiding member provided on the internal side surface of the cartridge for guiding the toner contained in the cartridge to be transported to the mouth.
Figure 10B:
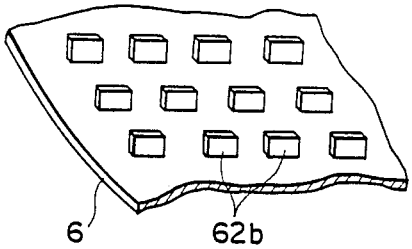
Figure 10C:
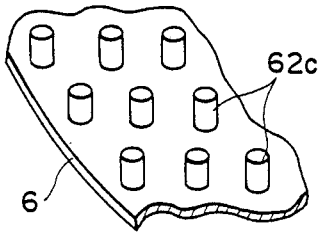
Figure 10D:
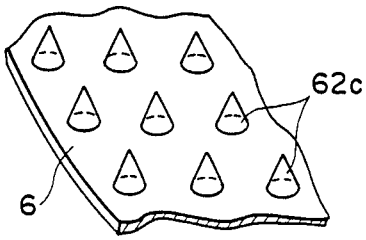

FIGS. 10*a* through 10*d* show several embodiments of toner guides provided in the inner peripheral surface of the toner cartridge 6. The toner guides 62*a* shown in FIG. 10*a* are formed by removing parts of the spiral guide rib 62 provided in the embodiment in FIG. 2*a*. FIG. 10*b* shows wall-shaped guides 62*b* which may also be inclined with respect to the longitudinal axis of the cylindrical cartridge 6, if desired. FIG. 10*c* shows an embodiment, in which pin-shaped guides 62*c* are provided as arranged in a spiral form at a predetermined pitch along the inner peripheral surface of the cartridge 6. FIG. 10*d* shows a further embodiment, in which conically shaped pins 62*c* are provided instead of the columnar pins 62*c* of FIG. 10*c*.

Figure 11:
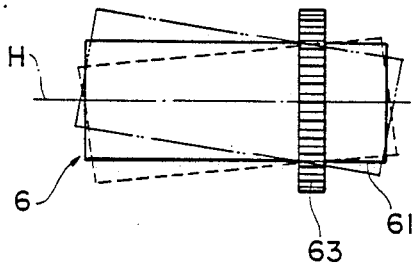
FIG. 11 is a schematic illustration showing a further embodiment of the present invention in which the cylindrical toner cartridge is held inclined with respect to the horizontal line.

FIG. 11 illustrates another embodiment, in which the cylindrical cartridge 6 may be held somewhat inclined with respect to the horizontal line H. Depending on the property of the toner contained in the cylindrical cartridge 6, the cartridge 6 may be held inclined with its mouth 61 facing upward, as indicated by the dotted line, or downward, as indicated by the two-dotted line. When the cartridge 6 is held with its mouth 61 directed downward, the toner contained in the cartridge 6 may be discharged at an increased speed; on the other hand, when the cartridge 6 is held with its mouth directed upward, discharge of toner from the cartridge 6 tends to slow down. It is thus preferable to provide a structure in which the orientation of the cartridge 6 at the toner replenishing position may be adjusted at least slightly either to direct its mouth downward or to to direct its mouth upward. Such a structure manifests itself to one skilled in the art and thus no further description is considered to be necessary.

Figure 12:
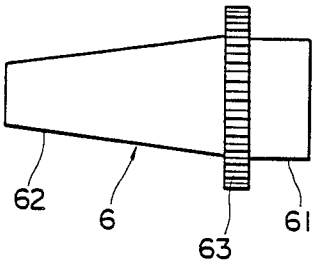
FIG. 12 is a schematic illustration showing a still further embodiment of the present invention in which the toner cartridge is generally conically shaped.

FIG. 12 shows a still further embodiment of the present invention, and it shows a generally conically shaped cartridge 6. That is, the cartridge 6 of FIG. 12 includes the cylindrical mouth 61 which is to be fitted into the cap-shaped receptacle 45 and a truncated conical portion 62 which contains therein a quantity of toner. With the use of such a conically shaped cartridge 6, even if it is held horizontally, the toner contained therein gradually moves toward the mouth 61. It is to be noted that the conical portion 62 may be completely conical and not truncated and the conical portion 6 may be curved inwardly or outwardly as desired.

Figure 13:
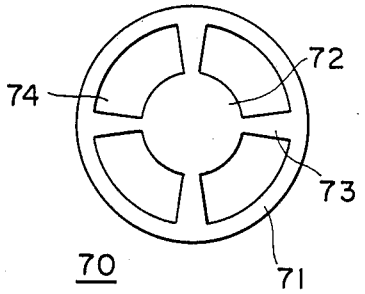
FIGS. 13 through 20 are schematic illustrations showing several embodiments of a toner discharge control member to be provided at the mouth of the toner cartridge.
Figure 14:
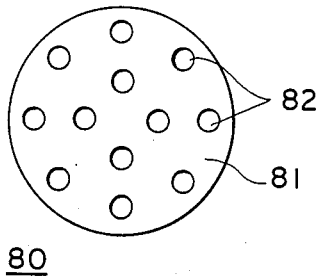

FIGS. 13 and 14 show two embodiments of a mouth piece 70 which is to be provided at the end of the mouth 61 of the cartridge 6. The mouth piece 70 shown in FIG. 13 includes an outer rim 71, a center core 72 and four bridging members 73 extending radially between the center core 72 and the outer rim 71 as spaced equally from one another. There are formed four openings 74 through which the toner contained in the cartridge 6 may be discharged. Thus, the mouth piece 70 serves to regulate the discharging flow of toner and to prevent the toner from flowing out excessively at a time. The mouth piece 80 of FIG. 14 includes a disc 81 which is provided with a plurality of through-holes 82 through which the toner may be discharged.

Figure 15:
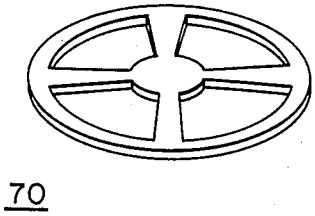
Figure 16:
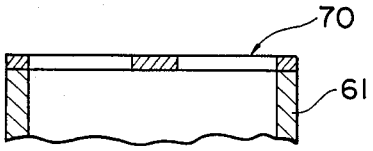
Figure 17:
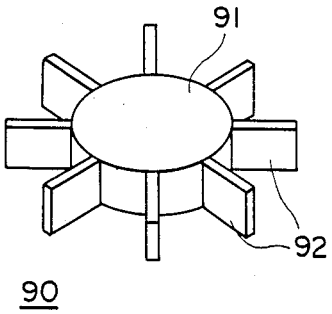
Figure 18:
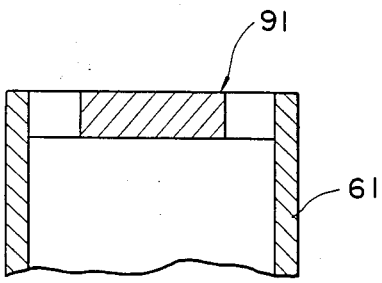
Figure 19:
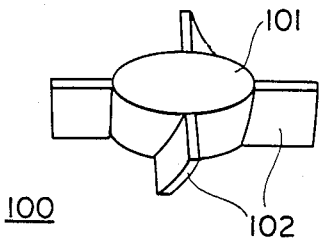
Figure 20:
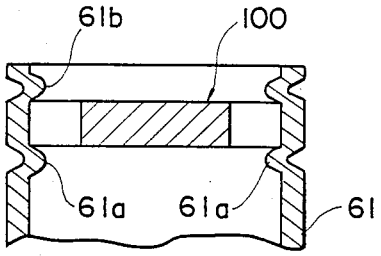

FIG. 15 is a perspective view showing the mouth piece 70 of FIG. 13, and FIG. 16 is a schematic illustration showing the condition in which the mouth piece 70 is fixedly attached to the end of the mouth portion 61, for example, by gluing. FIG. 17 shows a mouth piece 90 constructed in accordance with a further embodiment of the present invention, and it includes a center core 91 and a plurality of fins 92 provided around the core 91 as equally spaced one from another and extending radially outwardly from the core 91. FIG. 18 schematically shows the state in which the mouth piece 90 is fixedly provided at the mouth end. In this case, it is preferable if the outermost diameter of the mouth piece 90 is made slightly larger than the inner diameter of the mouth portion 61, because the mouth piece 90 then may be easily squeezed into the mouth portion 61. FIG. 19 shows a turbine-type mouth piece 100 which is a modification of the mouth piece 90 of FIG. 17. That is, the mouth piece 100 includes a core portion 101 and a plurality of turbine blades 102 provided around the core 101 equally spaced one from another and extending radially outwardly. FIG. 20 shows one example of mounting the turbine-type mouth piece 100 at the end of the mouth portion 61. In this case, inwardly projecting ridges 61*a* and 61*b* are formed in the mouth portion 61, so that the mouth piece 100 may be securely held in position.

Figure 21A:
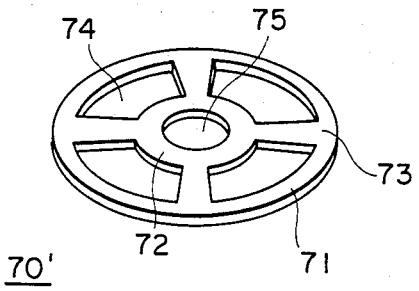
FIGS. 21*a* through 21*c* are schematic illustrations showing additional embodiments of the toner cartridge which may be advantageously used in the present toner replenishing device.
Figure 21B:
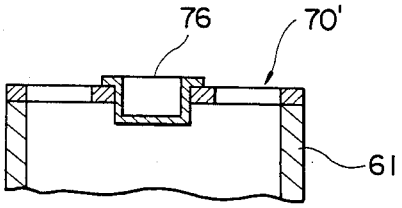
Figure 21C:
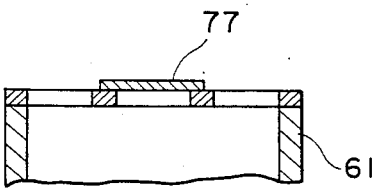

FIG. 21*a* shows a mouth piece 70' which is formed by providing a center hole 75 in the core portion 72 of the mouth piece 70 shown in FIG. 13. This center hole 75 may be advantageously used to pour toner into the cartridge. Thereafter, this center hole 75 may be plugged by snugly fitting an rnsert 76 into the center hole 75 as shown in FIG. 21*b* or by fixedly attaching a cover 77 across the center hole 75 as shown in FIG. 21*c*.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. Apparatus for replenishing toner from a cartridge to a desired location, comprising:

a cartridge containing toner, said cartridge being open at an end thereof for the egrees of toner, there being a circumferentially-extending gear disposed on an outer surface thereof;

a toner replenishing device for releasably holding said cartridge, said toner replenishing device comprising stationary receiving means for receiving therein said open end of said cartridge so as to allow the toner to be transferred into the interior of said toner replenishing device as discharged from said open end of said cartridge and means for supporting said cartridge in a substantially vertical first position for mounting or dismounting of said cartridge, for re-positioning said cartridge to a non-vertical second position for toner replenishing operation, and for supporting said cartridge in said second position, said supporting means normally keeping said open end of said cartridge in rotatable and sealing contact with said receiving means, said toner replenishing device comprising rotation means rotatable about an axis of rotation of said toner replenishing device for accomplishing said re-positioning of said cartridge, said toner replenishing device having a passage therein for allowing toner to pass from said cartridge to the interior of said toner replenishing device, said passage being disposed so as to communicate said open end of said cartridge with said interior of said toner replenishing device when said cartridge is in said second position;

driving means for rotating said cartridge about an axis of rotation of said cartridge, said driving means comprising gear means drivingly engaging said gear disposed on said cartridge when said cartridge is in said second position and being disengaged from said gear disposed on said cartridge when said cartridge is in said first position; and transporting means for transporting toner from the interior of said toner replenishing device to said desired location.

2. Apparatus as claimed in claim 1, wherein said cartridge comprises a mouth at said open end thereof and said receiving means comprises a cap-shaped receptacle, said mouth of said cartridge being rotationally and sealingly engaged in said cap-shaped receptacle when a said cartridge is in each of said first and second positions.

3. Apparatus as claimed in claim 1, wherein said toner replenishing device comprises means for supporting said cartridge such that said axis of rotation of said cartridge is perpendicular to said axis of rotation of said toner replenishing device when said cartridge is in each of said first and second positions.

4. Apparatus as claimed in claim 1, wherein said cartridge comprises a substantially cylindrical mouth portion and a conical portion extending longitudinally from said mouth portion.

5. Apparatus as claimed in claim 4, wherein said conical portion is truncated.

6. Apparatus as claimed in claim 1, wherein said toner replenishing device further comprises a holder for supporting said cartridge, said apparatus further comprising first mating means on said cartridge and second mating means on said holder, said first and second mating means comprising means for insuring that said characteristic of the toner in the cartridge is in accordance with a desired characteristic of toner to be introduced into said toner replenishing device.

7. Apparatus as claimed in claim 6, wherein said first mating means comprises a projection and said second mating means comprises a groove disposed at a location corresponding to the location of said projection when said cartridge is received in said toner replenishing device.

8. Apparatus as claimed in claim 7, wherein said cartridge is of a substantially cylindrical shape and said projection comprises a flange extending in a circumferential direction of said cartridge.

9. Apparatus as claimed in claim 1, further comprising guide means on an inner surface of said cartridge for moving said toner contained in said cartridge toward said open end of said cartridge in response to said rotation of said cartridge in response to said rotation of said cartridge by said driving means.

10. Apparatus as claimed in claim 9, wherein said guide means comprises a continuous spiral rib extending along said inner surface of said cartridge.

11. Apparatus as claimed in claim 9, wherein said guide means comprises a plurality of spaced toner guides disposed in a spiral pattern that extends along said inner surface of said cartridge.

12. Apparatus as claimed in claim 9, wherein said guide means comprises a plurality of pins disposed on said inner surface of said cartridge.

13. Apparatus as claimed in claim 12, wherein at least one of said pins is conic.

* * * * *